US012241228B2

(12) United States Patent
Williams et al.

(10) Patent No.: US 12,241,228 B2
(45) Date of Patent: Mar. 4, 2025

(54) WORKING MACHINE

(71) Applicant: J. C. Bamford Excavators Limited, Uttoxeter (GB)

(72) Inventors: Alan Geoffrey Williams, Uttoxeter (GB); Kevin Ford, Uttoxeter (GB)

(73) Assignee: J. C. Bamford Excavators Limited, Uttoxeter (GB)

( * ) Notice: Subject to any disclaimer, the term of this patent is extended or adjusted under 35 U.S.C. 154(b) by 376 days.

(21) Appl. No.: 17/583,175

(22) Filed: Jan. 24, 2022

(65) Prior Publication Data

US 2022/0235535 A1 Jul. 28, 2022

(30) Foreign Application Priority Data

Jan. 22, 2021 (GB) ..... 2100886

(51) Int. Cl.

| | |
|---|---|
| ***E02F 9/00*** | (2006.01) |
| ***E02F 9/20*** | (2006.01) |
| ***E02F 9/22*** | (2006.01) |
| *E02F 3/32* | (2006.01) |
| *E02F 3/84* | (2006.01) |

(52) U.S. Cl.

CPC ..... *E02F 9/2075* (2013.01); *E02F 9/2079* (2013.01); *E02F 9/2246* (2013.01); *E02F 3/32* (2013.01); *E02F 3/84* (2013.01)

(58) Field of Classification Search

CPC ..... E02F 9/2075; E02F 9/2079; E02F 9/2246; E02F 3/32; E02F 3/84

USPC ..... 701/50

See application file for complete search history.

(56) References Cited

U.S. PATENT DOCUMENTS

| | | | | |
|---|---|---|---|---|
| 2015/0039163 | A1 | 2/2015 | West | |
| 2016/0121722 | A1* | 5/2016 | Roberts | F15B 13/0401 180/242 |
| 2016/0121947 | A1* | 5/2016 | Lyle | E02F 9/08 180/54.1 |

FOREIGN PATENT DOCUMENTS

| | | | |
|---|---|---|---|
| EP | 0962597 | A2 | 12/1999 |
| EP | 1898104 | A1 | 3/2008 |
| EP | 2716823 | A1 | 4/2014 |

(Continued)

OTHER PUBLICATIONS

Search Report for GB 2100886.7, dated Nov. 2, 2021.
Extended European Search Report issued in EP 22152201.4, dated May 30, 2022.

*Primary Examiner* — Tiffany P Young
(74) *Attorney, Agent, or Firm* — MARSHALL, GERSTEIN & BORUN LLP

(57) ABSTRACT

An electric or hybrid working machine includes a ground engaging structure, an electrical source of power, an electric motor arrangement, one or more hydraulically actuated devices, and a hydraulic pump configured to supply hydraulic fluid to the one or more hydraulically actuated devices. The working machine also includes a transmission operable to transmit drive from the electric motor arrangement to the ground engaging structure and the hydraulic pump. The transmission has a first input member connected to a first electric motor, a drive train comprising a first input gear connected to the first input member, and a coupling device connected between the first input member and the first input gear to selectively adjust transmission of drive to the hydraulic pump and the ground engaging structure.

21 Claims, 3 Drawing Sheets

(56) References Cited

FOREIGN PATENT DOCUMENTS

EP 3666580 A1 6/2020

* cited by examiner

WORKING MACHINE

FIELD

The present teachings relate to a working machine, for example an electric or hybrid working machine.

BACKGROUND

Working machines (e.g. excavators, backhoe loaders, telehandlers, skid steer loaders etc.) typically include a number of hydraulically actuated devices, and a hydraulically driven ground engaging structure such as wheels or a pair of endless tracks. Depending on the particular working machine, a range of different hydraulically actuated devices may be provided, such as a working arm, stabilizer legs, a dozer blades, hydraulically powered steering, and these devices are operable by receiving a flow of hydraulic fluid from a hydraulic pump.

In such known working machines, propelling the working machine on the ground engaging structure and supplying hydraulic fluid for the hydraulically actuated devices are provided by separate motor-transmission arrangements. This approach requires both of the electric motors to be independently sized and results in inefficient packing on the working machine.

The present teachings seek to overcome or at least mitigate one or more problems associated with the prior art.

SUMMARY

A first aspect of the teachings provides an electric or hybrid working machine comprising: a ground engaging structure for propelling the working machine; an electrical source of power; an electric motor arrangement configured to be powered by the electrical source of power, the electric motor arrangement comprising at least one electric motor; one or more hydraulically actuated devices; a hydraulic pump configured to supply hydraulic fluid to the one or more hydraulically actuated devices; and a transmission operable to transmit drive from the electric motor arrangement to the ground engaging structure and the hydraulic pump, wherein the transmission comprises a first input member connected to a first electric motor of the electric motor arrangement and configured to be driven thereby, a drive train comprising a first input gear connected to the first input member, and a coupling device connected between the first input member and the first input gear to selectively adjust transmission of drive to the hydraulic pump and the ground engaging structure.

Advantageously, the combination of both hydraulic and traction function on the same transmission has been found to allow a low voltage solution to be used for the motor to deliver high voltage motor performance and remove redundancy in the machine. The inclusion of the coupling device allows the distribution of transmission between the hydraulics and traction to be optimized. For smaller machines, the use of one motor has been found to be advantage for packing reasons where two separate motors cannot be accommodated.

The coupling device may be configured to selectively couple and decouple transmission of drive to the hydraulic pump and the ground engaging structure based on whether the working machine is in a working mode or a travelling mode.

Advantageously, this enables the distribution of transmission to be optimized depending on the predetermined drive requirements associated with different modes of operation.

The coupling device may be configured to selectively decouple transmission of drive from the first input member to the ground engaging structure when the working machine is substantially stationary or wherein the working machine is travelling at a speed below a predetermined threshold, e.g. a low speed.

Advantageously, this enables a hydraulic pump speed to be maintained whilst the tractive speed requirement tends to zero, and for the hydraulic pump to be driven by the first electric motor arrangement independent of the ground engaging structure.

The coupling device may be configured to selectively decouple transmission of drive from the first input member to the hydraulic pump when the working machine is in a travelling mode and/or when demand for hydraulic supply to the one or more hydraulically actuated devices is low (i.e. below a pre-determined threshold).

Advantageously, this enables the transmission to the ground engaging structure to be prioritized when there is a greater requirement for tractive drive than hydraulic drive, e.g. when the working machine is being driven.

The coupling device may be configured to selectively couple transmission of drive from the first input member to the hydraulic pump and the ground engaging structure, when the working machine is in the working mode.

Advantageously, this enables drive to be transmitted to both the hydraulic pump and the ground engaging structure when there is such a requirement.

The working machine may comprise a controller configured to control the selective coupling and decoupling of the coupling device depending on the mode of operation of the working machine.

The controller may be configured to determine: when the working machine is travelling at a speed below the predetermined threshold; when the working machine is travelling at a speed above the predetermined threshold; and/or the demand of the one of more hydraulically actuated devices for hydraulic fluid supply.

The working machine may comprise a first sensor arrangement associated with the hydraulically actuated devices. The first sensor arrangement may for example, be configured to detect whether a hydraulically actuated device is being operated. The sensor arrangement may also be configured to detect the required flow rate of hydraulic fluid to the one or more hydraulically actuated devices.

The working machine may comprise a second sensor arrangement associated with the ground engaging. The second sensor arrangement may be configured to detect the speed of movement of the ground engaging structure.

The electric motor arrangement may comprise a second electric motor configured to be powered by the electrical source of power and the transmission comprises a second input member connected to the second electric motor and configured to be driven thereby. The coupling device may be configured to selectively decouple the first input gear from the first input member to inhibit transmission of drive between the first input member and the second input member when: the working machine is substantially stationary; the working machine is travelling at a speed below a predetermined threshold; when the working machine is in the travelling mode; and/or when demand for hydraulic supply to the one or more hydraulically actuated devices is below a predetermined threshold value.

Advantageously, this enables the ground engaging structure and hydraulic devices to be driven independently depending on the drive requirements. This has been found to increase the overall efficiency of the transmission.

The electric motor arrangement may comprise a second electric motor configured to be powered by the electrical source of power and the transmission comprises a second input member connected to the second electric motor and configured to be driven thereby. When the working machine is in working mode, the coupling device may be configured to selectively couple the first input gear to the first input member such that drive can be transmitted between the first input member and the second input member.

Advantageously, this enables the transmission of the ground engaging structure and the hydraulic devices to be combined when certain operating conditions have been met.

The coupling device may be any one of a torque converter, a fluid coupling or a slipping clutch.

Advantageously, this enables transmission of drive to the hydraulic pump even when the machine stalls. Additionally, if a torque converter is used, the torque output may be increased.

The transmission may comprise a lock up clutch configured to engage when the working machine is in a travelling mode.

The lock up clutch may be configured to engage when the working machine is travelling above a pre-determined speed.

Advantageously, this engages/attaches the motor and the transmission when their speeds are nearly equal, which results in an increase in efficiency.

The electric motor arrangement may comprise a second electric motor configured to be powered by the electrical source of power.

Advantageously, inclusion of a second motor has been found to enable the motor sizing for one or both of these services to be reduced compared to having separate transmission paths. Additionally, the use of multiple motors in one transmission has been found to reduce the required voltage and/or number of transmission ratios.

The transmission may comprise a second input member connected to the second electric motor and configured to be driven thereby.

The drive train may comprise a second input gear connected to the second input member.

Advantageously, this arrangement enables drive to be transmitted from both the first and second electric motor arrangements to both the hydraulic pump and the ground engaging structure.

The first electric motor may be configured to drive the hydraulic pump and the second electric motor is configured to drive the ground engaging structure.

The transmission may comprise a first output member connected to the hydraulic pump and a second output member connected to the ground engaging structure, and wherein the first and second output members may be configured to transmit drive from the electric motor arrangement.

The first input gear may be connected to the first output member via a coupling element. The first output member may be directly connected to the hydraulic pump.

The drive train may comprise a first output gear connected to the second output member.

Drive may be transmitted from the second input member to the second output member via the second input gear and the first output gear.

Advantageously, such an arrangement is a simple way of transmitting drive from the input members to both the hydraulic pump and the ground engaging structure.

The electric motor arrangement may comprise a second electric motor configured to be powered by the electrical source of power. The first electric motor may be connected to a first transfer shaft, and the second electric motor may be connected to a second transfer shaft. The first transfer shaft and the second transfer shaft may be configured to transmit drive to the first input member.

The working machine may comprise a body supported on the ground engaging structure.

The body may comprise an undercarriage supported on the ground engaging structure and a superstructure mounted to the undercarriage.

The superstructure may be rotatably mounted to the undercarriage.

The one or more hydraulically actuated devices may comprise a first working arm mounted to the body, and/or at least one stabilizer leg mounted to the body, and/or a dozer blade mounted to the body.

The ground engaging structure may be provided in the form of front and rear wheels or a pair of endless tracks.

The first input member may be a first input shaft, and/or the second input member may be a second input shaft, and/or the first output member may be a first output shaft and/or the second output member may be a second output shaft.

BRIEF DESCRIPTION OF THE DRAWINGS

Embodiments will now be described with reference to the accompanying drawings, in which.

DETAILED DESCRIPTION OF EMBODIMENT(S)

Figure 1:
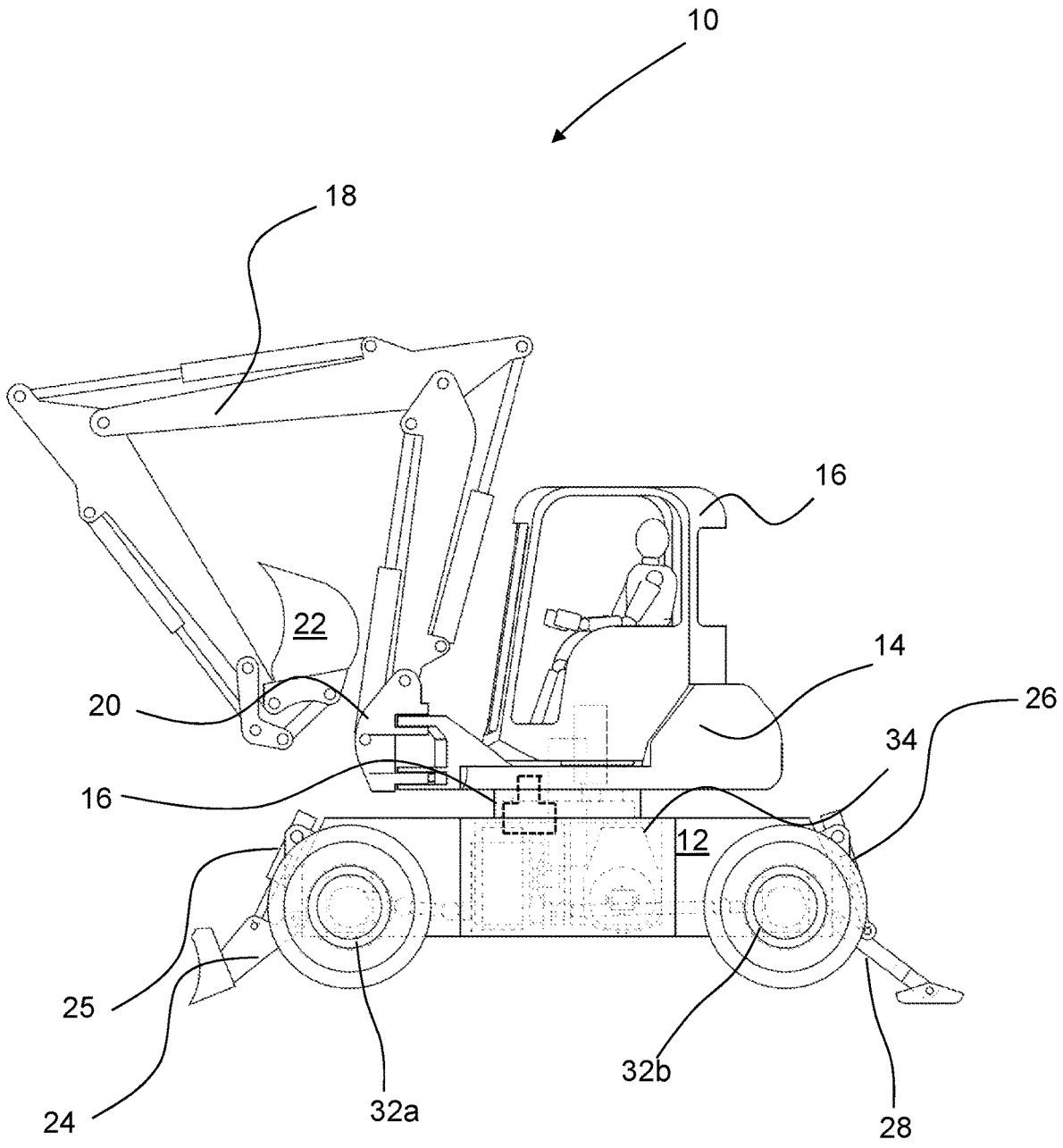
FIG. 1 is a side view of a working machine according to an embodiment.

Referring firstly to FIG. 1, a working machine according to an embodiment is indicated at 10. In the illustrated embodiment, the working machine 10 is an excavator, but it will be appreciated that in alternative embodiments the working machine may be a telehandler, backhoe loader, skid steer loader, or any other suitable working machine.

The working machine 10 includes a body. The body includes an undercarriage 12, and a superstructure 14 mounted to the undercarriage 12. In some arrangements, the working machine 10 may not include an undercarriage 12 and superstructure 14 and instead may include an operator structure 16 mounted onto a chassis of the body.

The working machine 10 includes an operator structure 16 from which an operator is able to operate the working machine 10. The operator structure 16 is provided on the superstructure 14. In the illustrated embodiment, the operator structure 16 is a cab, but in alternative arrangements it will be appreciated that a cab may not be provided and the operator structure 16 may include a frame and an operator sear, or may only include an operator seat.

In the illustrated embodiment, the superstructure 14 is rotatably mounted to the undercarriage 12. In alternative arrangements of the working machine 10, it will be appreciated that the superstructure 14 may not be rotatable relative to the undercarriage 12. In the present arrangement, the operator structure 16 is rotatably mounted to the superstructure 14. However, it will be understood that in some alternative arrangements of the working machine 10, the operator structure 16 may not be rotatable relative to the superstructure 14

The working machine 10 has one or more hydraulically actuated devices for performing functions of the working machine 10.

A working arm 18 is rotatably mounted to the superstructure 14 for performing working operations. The working arm 18 is pivotable about a substantially horizontal axis. The working arm 18 is mounted via kingpost arrangement 20. Mounting the working arm 18 via a kingpost enables the working arm to rotate about a substantially vertical axis relative to the body (i.e. the superstructure 14). Movement or operation of the working arm 18, e.g. pivoting, rotating, extending/retracting, crowding in/out, is actuated by hydraulic fluid, and so the working arm 18 is a first hydraulically actuated device.

The working arm 18 has a working implement 22 mounted at the distal end thereof. In the illustrated embodiment, the working implement 22 is a bucket, but in alternative arrangements any suitable working implement may be used such as forks, a shovel, a sweeper, a grapple etc. Movement or operation of the working implement 22, e.g. bucket curl/dump, pivoting etc., is actuated by hydraulic fluid, and so the working implement 22 is a second hydraulically actuated device.

The working machine 10 is provided with a dozer blade 24. The dozer blade 24 is provided on the undercarriage 12 of the working machine 10. Raising and lowering of the dozer blade 24 is actuated by hydraulic actuator 25, and so the dozer blade 24 is a third hydraulically actuated device.

The working machine 10 is provided with a pair of stabilizing legs 28. The stabilizing legs 28 are provided on the undercarriage 12 of the working machine 10. Raising and lowering of the stabilizer legs 28 is actuated by hydraulic actuator 26, and so the stabilizer legs 28 are a fourth hydraulically actuated device.

Further examples of hydraulically actuated devices for a working machine are: a hydraulic power steering device (not shown) for assisting with movement of steered axles or articulation actuators; a spring applied hydraulically released brake for parking the working machine; and hydraulic shock absorbers.

Each of the hydraulically actuated devices are supplied with hydraulic fluid from a hydraulic fluid reservoir along a hydraulic fluid flow path driven by a hydraulic pump 30.

The undercarriage 12 is connected to a ground engaging structure 32. The ground engaging structure includes wheels 32*a*, 32*b*. The wheels 32*a*, 32*b* are mounted to the undercarriage 12 via first and second drive axle assemblies. The second drive axle assembly is fixed with respect to the undercarriage 12, whereas the first drive axle assembly is capable of limited articulation, thereby permitting the wheels to remain in ground contact, even if the ground is uneven. The wheels 32*a*, 32*b* are typically provided with off-road pneumatic tires. In this embodiment, both drive axle assemblies are steer axles, but this may not always be the case. In alternative arrangements, the ground engaging structure 32 may include a pair of endless tracks.

When an operator wishes to move the working machine 10, the operator can use controls such as the steering wheel, a foot brake, a foot clutch, a foot accelerator, forward and reverse levers and a gear box having forward and reverse gears to move the working machine 10 over the ground. When it is necessary to move the working machine 10 a distance from one location to another location, the dozer blade 24 and stabilizer legs 28 will be lifted above ground level and the working machine 10 can be driven. This corresponds to the working machine 10 being in a moving mode or state.

When the operator wishes to use the working machine 10, i.e. to carry out a working operation, the working machine 10 is considered to be in a working mode or state. When using the working machine 10, the working machine 10 may be substantially stationary or the working machine 10 may be travelling at a low speed below a predetermined threshold. In this condition, some or all of the ground engaging structure may be lifted off the ground by operation of stabilizer legs 28 and/or lowering of the dozer blade 24 into engagement with the ground.

Figure 2:
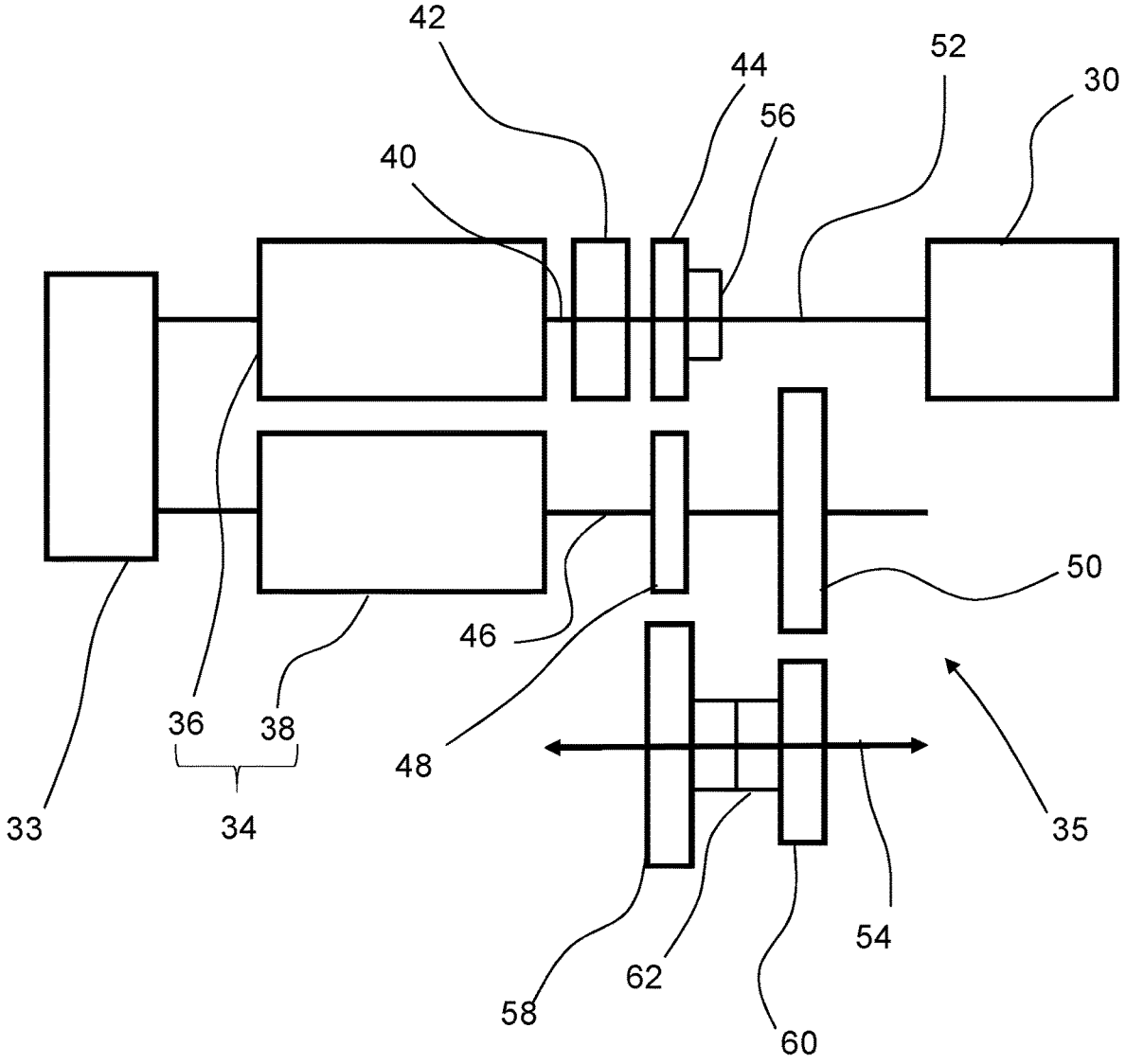
FIG. 2 is a schematic representation of a drive arrangement of the working machine of FIG. 1.

Referring to FIG. 2, a drive arrangement of the working machine 10 is illustrated. The drive arrangement includes an electric motor arrangement and a transmission.

The working machine 10 has an electrical source of power 33. In the present arrangement, the electrical source of power 33 is a battery. The electrical source of power 33 provides power to an electric drive arrangement 34. The electric motor arrangement 34 is configured to drive the hydraulic pump 30 to power the hydraulically actuated devices. The electric motor arrangement 34 is configured to drive the ground engaging structure 32 to propel the working machine 10.

The working machine 10 may be considered to be an electric working machine 10. In alternative arrangements, the working machine may also include an internal combustion engine, e.g. to charge the electrical source of power 33, and so may be a hybrid working machine.

The electric motor arrangement includes a first electric motor 36 and a second electric motor 38. Incorporating a plurality of electric motors has been found to reduce both the required voltage of each of the electric motors and the number of transmission ratios.

The first electric motor 36 is configured to drive the hydraulic pump 30. The first electric motor 36 is able to be adjusted to vary the output of the hydraulic pump 30 to meet the hydraulic fluid demand of the hydraulically actuated devices. The second electric motor 38 is configured to drive the ground engaging structure 32. It shall be appreciated that in alternative embodiments, the first electric motor 36 may be configured to drive the ground engaging structure 32, and the second electric motor 38 may be configured to drive the hydraulic pump 30.

The working machine 10 includes a transmission 35. The transmission 35 is operable to transmit drive from the electric motor arrangement 34 to the ground engaging structure 32 and to the hydraulic pump 30.

The transmission 35 includes a first input member 40 that is connected to the first electric motor 36 so as to be driven thereby. The transmission 35 includes a second input member 46 that is connected to the second electric motor 38 so as to be driven thereby. In order to transmit drive to the hydraulic pump 30 and the ground engaging structure 32, the transmission 35 includes a first output member 52 connected to the hydraulic pump 30, and a second output member 54 connected to the ground engaging structure 32. The input and output members 40, 46, 52 and 54 each define a longitudinal axis, and each of the longitudinal axes are parallel to one another.

The transmission 35 includes a drive train to facilitate transmission of drive. In the embodiment, the drive train enables the transmission of drive between the input and output members 40, 46, 52 and 54. The drive train includes a first input gear 44 connected to the first input member 40. The drive train includes a second input gear 48 connected to the second input member 46. The drive train includes a third input gear 50 connected to the second input member 46. The third input gear 50 is spaced apart from the second input gear 48. In order to transmit drive to the second output member 54, the drive train includes at least one output gear. In this embodiment, the drive train includes a first output gear 58 and a second output gear 60 connected to the second output member 54 and spaced apart.

The first input member 40 is connected to the first electric motor 36 at a first end thereof, and to the first input gear 44 at a second end. The first output member 52 is connected at a first end to the first input gear 44 of the first input member 40. The first output member 52 is directly connected to the hydraulic pump 30 at a second end. A first coupling element 56 is used to couple the first output member 52 to the first input gear 44. As such, drive is transmitted from the first electric motor 36 to the hydraulic pump 30. In alternative embodiments, the coupling element 56 may be used to couple the first input member to the first input gear, and the first input gear may instead be connected to the first output member.

The first input gear 44 and the second input gear 48 are in meshing engagement so as to transmit drive between the first input member 40 and the second input member 46. Put another way, the first input gear 44 and the second input gear 48 are aligned along the transmission such that they inter-engage.

The transmission 35 is configured to transmit drive from the second input member 46 to the second output member 54 via the second and third input gears 48, 50, and the first and second output gears 58, 60. The second input gear 48 and the first output gear 58 are in meshing engagement such that drive is transmitted therebetween. The third input gear 50 and the second output gear 60 are in meshing engagement such that drive is transmitted therebetween.

The second output member 54 is connected, either directly or indirectly, to the ground engaging structure 32. The second output member 54 may be directly or indirectly connected to the first axle assembly associated with the first set of wheels 32*a*, and the second axle assembly associated with the second set of wheels 32*b*.

The second output member 54 is provided in the form of two output shafts. The first output gear 58 is connected to one of the output shafts, and the second output gear 60 is connected to the other one of the output shafts. The two output shafts are rotationally locked together. The two output shafts are coupled together using a second coupling element 62. However, it shall be appreciated that in alternative embodiments the second output member may be provided as a single output shaft.

A coupling device 42 is provided to selectively adjust transmission of drive to the hydraulic pump 30 and the ground engaging structure 32. The coupling device 42 is connected between the first input gear 44 and the first input member 40. The coupling device 42 is connected to the input member 40 associated with the hydraulic pump 30. In alternative embodiments, the coupling device 42 may be connected to the input member associated with the ground engaging structure 32.

The coupling device 42 may be any one of a torque converter, a fluid coupling and a slipping clutch. The use of any one these coupling devices enables transmission of drive to the hydraulic pump 30 even when the machine stalls, and enables both independent and combined transmission. In the embodiment described below, the coupling device 42 is a torque converter. This is advantageous because the torque output may be increased.

In an alternative embodiment, the transmission of the first electric motor and the second electric motor may be combined prior to transmitting drive to the first input member. For example, a first transfer shaft connected to the first electric motor, and a second transfer shaft connected to the second electric motor, could both transmit drive to the first input member. The selective coupling and decoupling of the coupling device would therefore occur after the combination of drive from the first and second motors.

The transmission 35 includes a lock up clutch. The lock up clutch is configured to be used (i.e. to be operational) when the working machine is in a travelling mode. Put another way, the lock up cutch engages/activates when the working machine is in travelling mode, e.g. when travelling at high machine speed, and hydraulic demand is low. The lockup clutch is located in front of the torque converter and has the advantage of preventing slip at high speeds.

The coupling device 42 is configured to selectively couple and decouple transmission of drive. The coupling device 42 is configured to selectively couple and decouple transmission of drive to the hydraulic pump 30 and the ground engaging structure 32. The coupling and decoupling of the transmission of drive is dependent on whether the working machine 10 is in a working mode or a travelling mode. This enables the distribution of transmission to be optimized depending on the different modes of operation of the working machine 10.

When the working machine 10 is in a working mode, the predetermined drive requirement of the ground engaging structure 32 will be low, or at a minimum. The transmission 35 is therefore configured to prioritize distribution of drive to the hydraulic pump 30. The coupling device 42 selectively decouples transmission of drive from the first input member 40 to the ground engaging structure 32. The predetermined threshold may be in the range of 0 km/h to 10 km/h.

When the working machine 10 is in the working mode, there is a drive requirement of both the hydraulically actuated devices and the ground engaging structure 32. The working machine 10 is operating in working mode when the speed of the working machine 10 is above the predetermined threshold. It is therefore advantageous that the electric drive arrangement 34 transmits drive to both the ground engaging structure 32 and the hydraulic pump 30 simultaneously. The coupling device 42 is therefore configured to selectively couple transmission of drive from the first input member 40 to both the hydraulic pump 30 and the ground engaging structure 32.

When the working machine 10 is in travelling mode and/or when demand for hydraulic supply to the one or more hydraulically actuated devices is low, the transmission 35 is configured to prioritize the distribution of drive to the ground engaging structure 32. The coupling device 42 is therefore configured to selectively decouple transmission of drive from the first input member 40 to the hydraulic pump 30.

The working machine 10 includes a controller configured to control the selective coupling and decoupling of the coupling device 42 based on the operational mode of the working machine 10. The controller is therefore configured to determine the speed of the working machine 10 and to compare it to the predetermined threshold, and to monitor the demand of the one or more hydraulically actuated devices for hydraulic fluid supply. The controller is configured to determine the mode and operating condition of the working machine 10, and operate the coupling device 42 to selectively couple and decouple and transmission accordingly. Alternatively, operation of the transmission 35 may be manually controlled by the operator.

In order to detect the conditions of the working machine 10, the working machine may include a sensor arrangement (not shown). The working machine 10 may include a first sensor arrangement associated with the hydraulically actuated devices. The first sensor arrangement may for example, be configured to detect whether a hydraulically actuated device is being operated. The sensor arrangement may also be configured to detect the required flow rate of hydraulic fluid to the one or more hydraulically actuated devices. The working machine 10 may include a second sensor arrangement associated with the ground engaging structure 32. The second sensor arrangement may be configured to detect the speed of movement of the ground engaging structure 32.

Operation of the coupling device 42 is described below.

When the working machine 10 is in the working mode, it is advantageous for transmission of drive to the hydraulic pump 30 and the ground engaging structure 32 to be independent of one another. When the working machine 10 is in the travelling mode and/or when demand for hydraulic supply to the one or more hydraulically actuated devices is low, it is advantageous for transmission of drive to the hydraulic pump 30 and the ground engaging structure 32 to be independent of one another.

The coupling device 42 is configured to selectively decouple the first input gear 44 from the first input member 40. Transmission of drive between the first input member 40 and the second input member 46 is therefore inhibited. The hydraulic pump 30 is driven by the first electric motor 36, and the ground engaging structure 32 is independently driven by the second electric motor 38.

This enables the first and second motors 36, 38 to drive the hydraulic pump 30 and the ground engaging structure 32 at different speeds depending on the drive requirements of the mode of operation. For example, if the working machine 10 is stationary or moving at low speed and one of the hydraulically actuated devices is being operated, the output of the second electric motor 38 is can be reduced. The output of the first electric motor 36 can then be increased such that the output of the hydraulic pump 30 matches the demand of the one or more hydraulically actuated devices for hydraulic fluid supply. If the working machine 10 is in travelling mode and the demand for hydraulic fluid is low, the output of the first electric motor 36 can be reduced and the output of the second electric motor 36 can be increased to match the drive requirement of the ground engaging structure 32.

When the working machine 10 is in working mode, there is a demand for drive to both the hydraulic pump 30 and the ground engaging structure 32. It is therefore advantageous for transmission of drive to the ground engaging structure 32 and the hydraulic pump 30 to be combined. The coupling device 42 is configured to selectively couple the first input gear 44 to the first input member 40. Transmission of drive to the first input member 40 and the second input member 46 is therefore combined. As such, both the first and second motors 36, 38 may be driven to optimize the efficiency of transmission.

Figure 3:
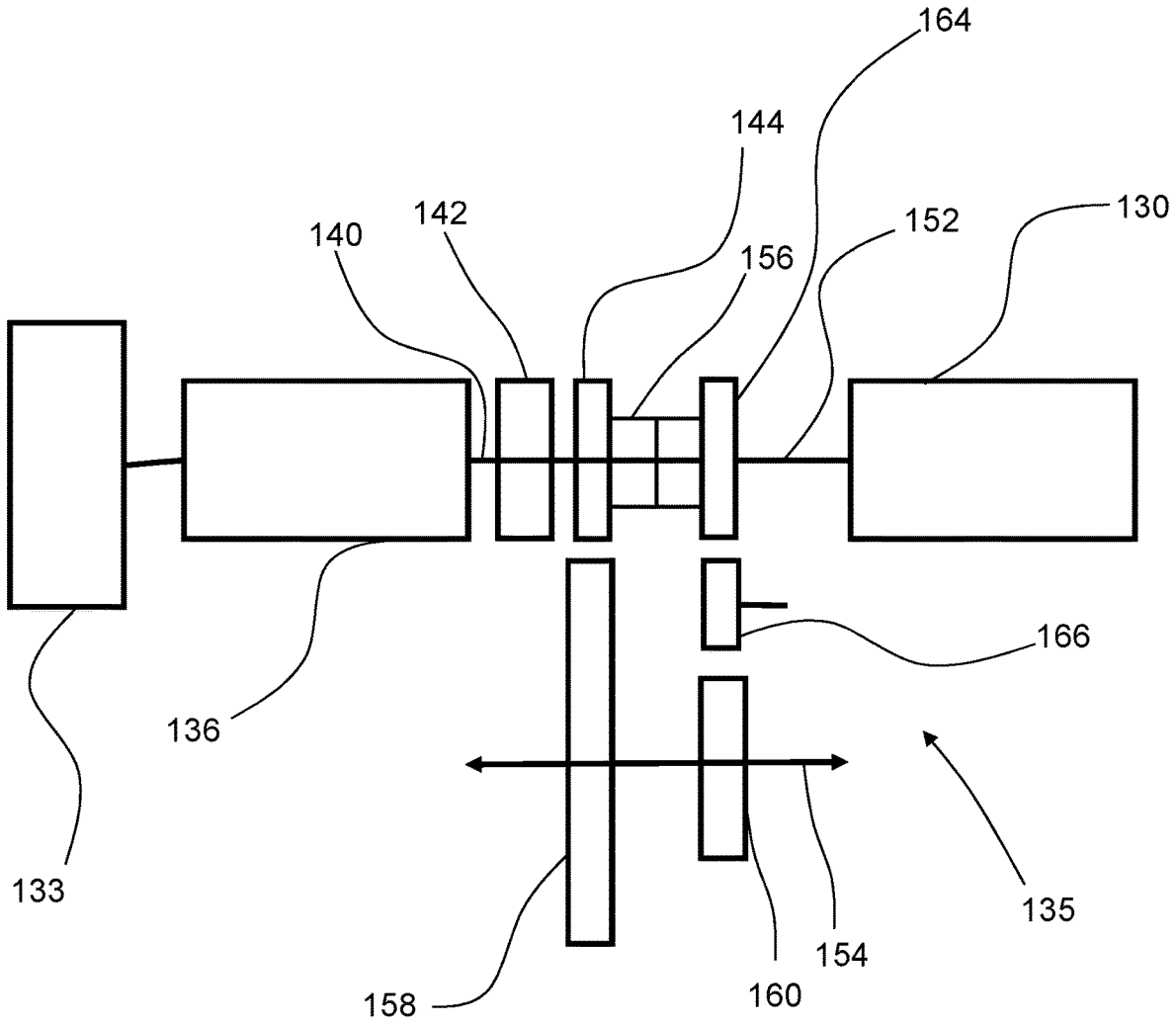
FIG. 3 is a schematic representation of an alternative drive arrangement of the working machine of FIG. 1.

Referring to FIG. 3, an alternative drive arrangement of the working machine 10 is illustrated. Similar parts to the embodiment of FIG. 2 are labelled by like reference numerals with prefix "1". The differences with respect to the embodiment of FIG. 2 are discussed below.

The drive arrangement includes an electric motor arrangement and a transmission. The electric motor arrangement 34 includes a single electric motor 136. It may be particularly advantageous to include a single electric motor in small machines where space is particularly limited. The electric motor 136 is configured to drive both the hydraulic pump 130 and the ground engaging structure 32. The drive train includes an additional output gear 164 connected to the first output member 152. The electrical source of power 133 provides power to the electric motor 136.

The working machine 10 includes a transmission 135. The transmission 135 includes the first input member 140 connected to the connected to the electric motor 136 to be driven thereby. In order to transmit drive to the hydraulic pump 130 and the ground engaging structure 32, the transmission 135 includes the first output member 152 connected to the hydraulic pump 130, and the second output member 154 connected to the ground engaging structure 32. The input and outputs members 140, 152 and 154 each define a longitudinal axis, and each of the longitudinal axes are parallel to one another.

The transmission 135 also includes the drive train to facilitate transmission of drive between the input and output members 140, 152 and 154. The drive train includes the first input gear 144 connected to the first input member 140. An additional output gear 164 is also connected to the first output member 154, and an additional transfer gear 166 is provided. The drive train also includes the first output gear 158 and the second output gear 160 connected to the second output member 154 and spaced apart.

The first input member 140 is connected to the electric motor 136 at the first end, and to the first input gear 144 at the second end. The first coupling element 156 is provided to couple the first input member 140 to the output gear 164, and to couple the first output member 152 to the first input gear 142. As such, drive is transmitted from the electric motor 136 to the hydraulic pump 130.

The first input gear 144 and the first output gear 158 are positioned adjacent one another so as to transmit drive from the first input member 140 to the second output member 154. Put another way, the first input gear 144 and the first output gear 158 are aligned along the transmission such that they mesh together and transmit drive therebetween.

The transmission is configured to transmit drive between the first output member 152 and the second output member 154. This transmission of drive occurs via the transfer gear 166. The output gear 164, the transfer gear 166 and the second output gear 160 are in alignment along the transmission 135 such that they mesh together and drive is transmitted therebetween.

The second output member 154 may be directly or indirectly connected to the first axle assembly associated with the first set of wheels 32*a*, and the second axle assembly associated with the second set of wheels 32*b*.

The input and output members of this embodiment are shafts. However it shall be appreciated that in alternative embodiments, the input and output members may be any suitable device, for example belts or chains.

The second output member 154 is provided in the form of a single output shaft 154. However, in alternative embodiments, the second output member may be provided in the form of two output shafts coupled together.

The coupling device 142 is provided to selectively adjust the transmission of drive to the hydraulic pump 130 and the ground engaging structure 32. Similarly to the first embodiment, the coupling device 142 is connected between the first input member 140 and the first input gear 144.

Operation of the coupling device 142 is described below.

When the working machine 10 is in a working mode and there is demand for hydraulic supply to one or more of the hydraulically actuated devices it is advantageous for transmission of drive to the hydraulic pump 130 to occur independent of transmission to the ground engaging structure 132. As such, the coupling device 142 is configured to selectively decouple the first input gear 144 from the first input member 140, and to selectively decouple the output gear 164 from the second input member 152. This enables the electric motor 136 to drive the hydraulic pump 130 to meet the demand of the one or more hydraulically actuated devices, whilst inhibiting transmission of drive to the ground engaging structure 32.

Alternatively, when the working machine is in working mode, there is a demand for drive to both the hydraulic pump 130 and the ground engaging structure 32. The coupling device 142 is therefore configured to selectively couple the first input gear 144 to the first input member 140, and to selectively couple the output gear 164 from the second input member 152.

Although the teachings have been described above with reference to one or more preferred embodiments, it will be appreciated that various changes or modifications may be made without departing from the scope as defined in the appended claims.

The invention claimed is:

1. An electric or hybrid working machine comprising:

a ground engaging structure for propelling the working machine;

an electrical source of power;

an electric motor arrangement configured to be powered by the electrical source of power, the electric motor arrangement comprising at least one electric motor;

one or more hydraulically actuated devices;

a hydraulic pump configured to supply hydraulic fluid to the one or more hydraulically actuated devices; and a transmission operable to transmit drive from the electric motor arrangement to the ground engaging structure and the hydraulic pump, wherein the transmission comprises:

a first input member connected to a first electric motor of the electric motor arrangement and configured to be directly driven thereby, a drive train comprising a first input gear connected to the first input member, and a coupling device connected between the first input member and the first input gear to selectively adjust transmission of drive to the hydraulic pump and the ground engaging structure.

2. The working machine of claim 1, wherein the coupling device is configured to selectively couple and decouple transmission of drive to the hydraulic pump and the ground engaging structure based on whether the working machine is in a working mode or a travelling mode.

3. The working machine of claim 1, wherein the coupling device is configured to selectively decouple transmission of drive from the first input member to the ground engaging structure when the working machine is substantially stationary or wherein the working machine is travelling at a speed below a predetermined threshold.

4. The working machine of claim 1, wherein the coupling device is configured to selectively decouple transmission of drive from the first input member to the hydraulic pump when the working machine is in a travelling mode and/or when demand for hydraulic supply to the one or more hydraulically actuated devices below a pre-determined threshold, e.g. when the demand is low.

5. The working machine of claim 2, wherein the coupling device is configured to selectively couple transmission of drive from the first input member to the hydraulic pump and the ground engaging structure, when the working machine is in the working mode.

6. The working machine of claim 2, comprising a controller configured to control the selective coupling and decoupling of the coupling device depending on the mode of operation of the working machine.

7. The working machine of claim 6, comprising a first sensor arrangement associated with the hydraulically actuated devices configured to detect whether a hydraulically actuated device is being operated and/or the required flow rate of hydraulic fluid to the one or more hydraulically actuated devices.

8. The working machine of claim 1, wherein the electric motor arrangement comprises a second electric motor configured to be powered by the electrical source of power and the transmission comprises a second input member connected to the second electric motor and configured to be driven thereby, and wherein the coupling device is configured to selectively decouple the first input gear from the first input member to inhibit transmission of drive between the first input member and the second input member when: the working machine is substantially stationary; the working machine is travelling at a speed below a predetermined threshold; when the working machine is in the travelling mode; and/or when demand for hydraulic supply to the one or more hydraulically actuated devices is below a predetermined threshold value.

9. The working machine of claim 1, wherein the electric motor arrangement comprises a second electric motor configured to be powered by the electrical source of power and the transmission comprises a second input member connected to the second electric motor and configured to be driven thereby, wherein, when the working machine is in working mode, the coupling device is configured to selectively couple the first input gear to the first input member such that drive can be transmitted between the first input member and the second input member.

10. The working machine of claim 1, wherein the coupling device is any one of a torque converter, a fluid coupling or a slipping clutch.

11. The working machine of claim 1, wherein the transmission comprises a lock up clutch configured to engage when the working machine is in a travelling mode, optionally wherein the lock up clutch is configured to engage when the working machine is travelling above a pre-determined speed.

12. The working machine of claim 1, wherein the electric motor arrangement comprises a second electric motor configured to be powered by the electrical source of power.

13. The working machine of claim 12, wherein the transmission comprises a second input member connected to the second electric motor and configured to be driven thereby, optionally wherein the drive train comprises a second input gear connected to the second input member.

14. The working machine of claim 12, wherein the first electric motor is configured to drive the hydraulic pump and the second electric motor is configured to drive the ground engaging structure.

15. The working machine of claim 1, wherein the transmission comprises a first output member connected to the hydraulic pump and a second output member connected to the ground engaging structure, and wherein the first and second output members are configured to transmit drive from the electric motor arrangement, optionally wherein the first input gear is connected to the first output member via a coupling element, and wherein the first output member is directly connected to the hydraulic pump.

16. The working machine of claim 15, wherein the drive train comprises a first output gear connected to the second output member, optionally wherein drive is transmitted from the second input member to the second output member via the second input gear and the first output gear.

17. The working machine of claim 1, wherein the electric motor arrangement comprises a second electric motor configured to be powered by the electrical source of power, wherein the first electric motor is connected to a first transfer shaft, and the second electric motor is connected to a second transfer shaft, and wherein the first transfer shaft and the second transfer shaft are configured to transmit drive to the first input member.

18. The working machine of claim 1, comprising a body supported on the ground engaging structure, optionally wherein the body comprises an undercarriage supported on the ground engaging structure and a superstructure mounted to the undercarriage, optionally wherein the superstructure is rotatably mounted to the undercarriage.

19. The working machine of claim 18, wherein the one or more hydraulically actuated devices comprises a first working arm mounted to the body and/or at least one stabilizer leg mounted to the body and/or a dozer blade mounted to the body.

20. The working machine of claim 1, wherein the first input member is a first input shaft, and/or the second input member is a second input shaft, and/or the first output member is a first output shaft and/or the second output member is a second output shaft.

21. An electric or hybrid working machine comprising:

a ground engaging structure for propelling the working machine;

an electrical source of power;

an electric motor arrangement configured to be powered by the electrical source of power, the electric motor arrangement comprising at least one electric motor;

one or more hydraulically actuated devices;

a hydraulic pump configured to supply hydraulic fluid to the one or more hydraulically actuated devices; and a transmission operable to transmit drive from the electric motor arrangement to the ground engaging structure and the hydraulic pump, wherein the transmission comprises:

a first input member directly connected to a first electric motor of the electric motor arrangement and configured to be driven thereby, a drive train comprising a first input gear connected to the first input member, and a coupling device connected between the first input member and the first input gear to selectively adjust transmission of drive to the hydraulic pump and the ground engaging structure.

* * * * *